US006662399B1

(12) United States Patent
Vairo

(10) Patent No.: US 6,662,399 B1
(45) Date of Patent: Dec. 16, 2003

(54) ICE SCRAPER

(76) Inventor: Christopher M. Vairo, 12911 Josephine St., Omaha, NE (US) 68138

( * ) Notice: Subject to any disclaimer, the term of this patent is extended or adjusted under 35 U.S.C. 154(b) by 0 days.

(21) Appl. No.: 10/377,940

(22) Filed: Feb. 28, 2003

(51) Int. Cl.[7] ..... A47L 13/12

(52) U.S. Cl. ..... 15/111; 15/143.1; 15/236.01; 15/236.02

(58) Field of Search ..... 15/111, 143.1, 15/236.01, 236.02

(56) References Cited

U.S. PATENT DOCUMENTS 712,843 A * 11/1902 Paul
4,041,564 A 8/1977 Schlicher
4,813,458 A * 3/1989 Jacobucci
4,888,846 A 12/1989 Natale
4,962,561 A 10/1990 Hamilton
5,379,758 A * 1/1995 Snyder
5,402,550 A * 4/1995 Lessard
5,455,981 A 10/1995 Wiese
5,471,698 A * 12/1995 Francis
5,471,700 A * 12/1995 Pereira
5,593,460 A * 1/1997 Lessard
6,061,862 A * 5/2000 Whitaker
D463,083 S 9/2002 Kari et al.

* cited by examiner

*Primary Examiner*—Randall E. Chin
(74) *Attorney, Agent, or Firm*—Thomte, Mazour & Niebergall; Dennis L. Thomte

(57) ABSTRACT

An ice scraper comprising an elongated handle portion having a scraper blade mounted at one end thereof and a U-shaped yoke mounted at the other end thereof. The U-shaped yoke comprises a pair of spaced-apart yoke members which have a U-shaped arm or wrist engaging member secured thereto and which extends therebetween. An optional brush may be secured to the handle portion adjacent the scraper blade but disposed oppositely thereto. The ice scraper may be used as an ice scraper or as a snow brush.

4 Claims, 3 Drawing Sheets

ICE SCRAPER

BACKGROUND OF THE INVENTION

1. Field of the Invention

This invention relates to an ice scraper for use in scraping snow and ice from automobile windows. More particularly, this invention relates to an ice scraper having means associated therewith to enable the user thereof to apply greater leverage or pressure to the scraper blade thereon.

2. Description of the Related Art

Many hundreds of differently designed ice scrapers have been previously provided for scraping snow and ice from automobile windows. Some ice scrapers are fairly short arcuate devices while others comprise an elongated handle having a scraper blade at one end thereof. Further, some ice scrapers employ a scraper at one end of an elongated handle with a brush being mounted on the other end thereof. If a short ice scraper is used, it is difficult for the user to sufficiently reach across the windshield to scrape the ice and snow therefrom. Although the longer ice scrapers described above provide an extended reach, it is difficult for the user to apply sufficient scraping pressure to the scraper blade.

SUMMARY OF THE INVENTION

An improved ice scraper is disclosed which includes an elongated handle having opposite ends. A conventional ice scraper blade is provided on end of the handle portion with that same end of the handle portion having an optional brush mounted thereon which is disposed opposite to the ice scraper blade. A U-shaped yoke is provided at the other end of the handle portion and includes spaced-apart yoke members which have a U-shaped arm or wrist engaging member secured thereto which extends therebetween. The user grasps the elongated handle in a manner such that the U-shaped engaging member extends over the wrist or lower arm of the user. The U-shaped engaging member enables the user to apply sufficient scraping pressure to the scraper blade so that snow and ice may be removed from the automobile window.

It is therefore a principal object of the invention to provide an improved ice scraper.

A further object of the invention is to provide an ice scraper for use in scraping snow and ice from automobile windows which has means associated therewith to enable the user thereof to apply greater leverage or pressure to the scraper blade thereon.

Yet another object of the invention is to provide an ice scraper of the type described above which is reversible in that pressure may be applied to either a scraper blade or brush.

Still another object of the invention is to provide an ice scraper which is durable in use, refined in appearance and economical of manufacture.

These and other objects will be apparent to those skilled in the art.

DESCRIPTION OF THE PREFERRED EMBODIMENT

Figure 1:
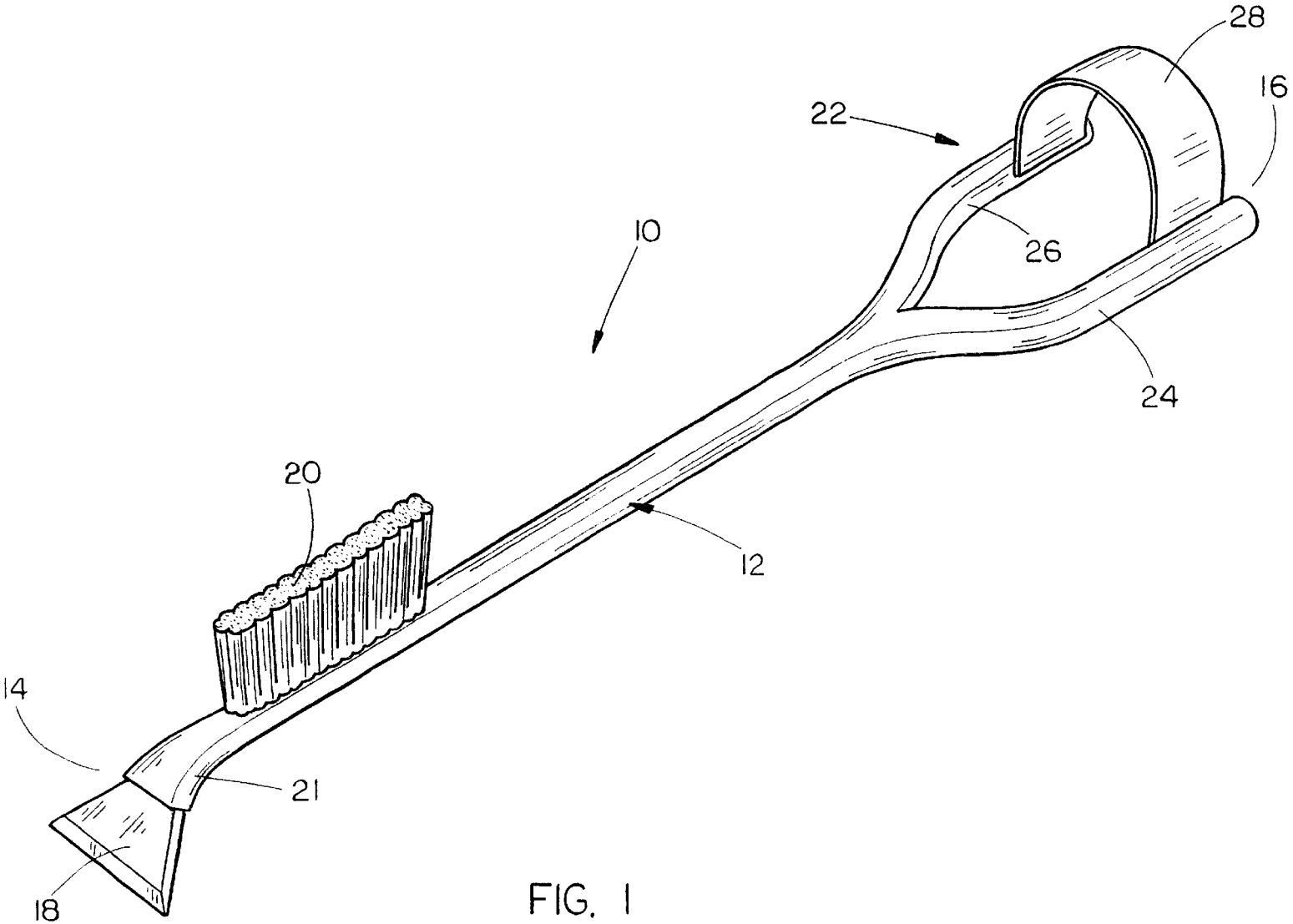
FIG. 1 is a perspective view of the ice scraper of this invention.

The ice scraper of this invention is referred to generally by the reference numeral 10. Scraper 10 includes an elongated handle portion 12 having ends 14 and 16. A conventional ice scraper blade 18 is provided on end 14 of handle portion 12. An optional brush 20 may also be provided at end 14 of the handle portion 12 adjacent blade 16, but opposite thereto, as seen in the drawings. Handle portion 12 is preferably straight but may be angular or curved if so desired. Handle portion 12 may be constructed of wood, plastic, etc. As seen in FIG. 1, the handle portion 12 has a curved portion 21 adjacent blade 18. Blade 18 may be plastic, metal, or other suitable material. Blade 18 may be integrally formed with handle portion 12 or formed separately thereof. Handle portion 12 may have a round, square or rectangular cross-section.

Figure 3:
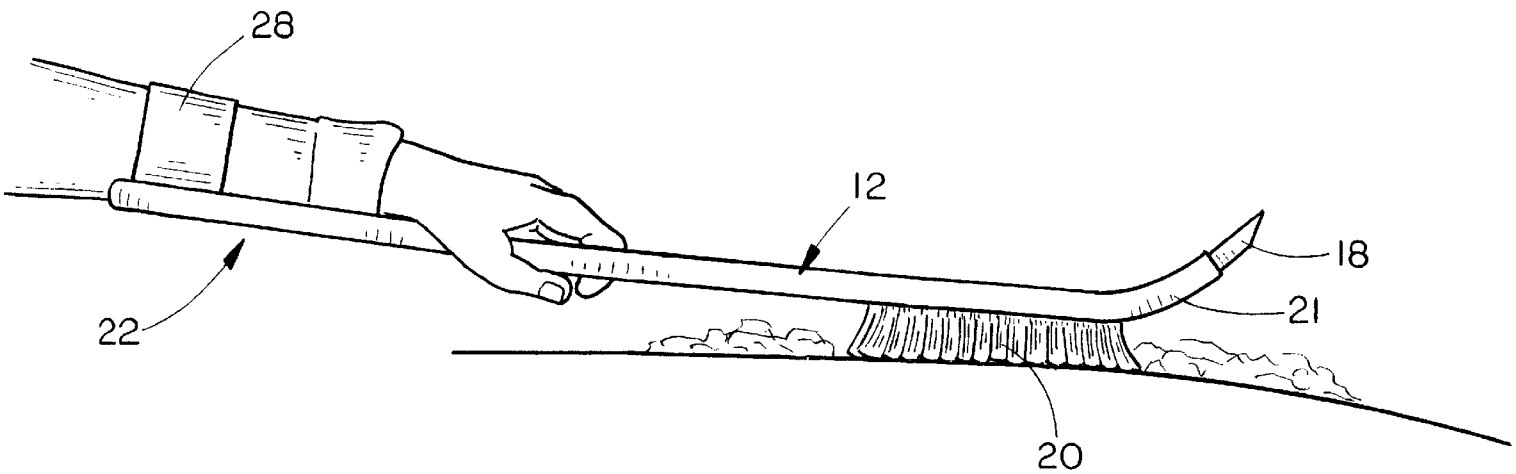
FIG. 3 is a view illustrating the invention being used to brush snow.
Figure 4:
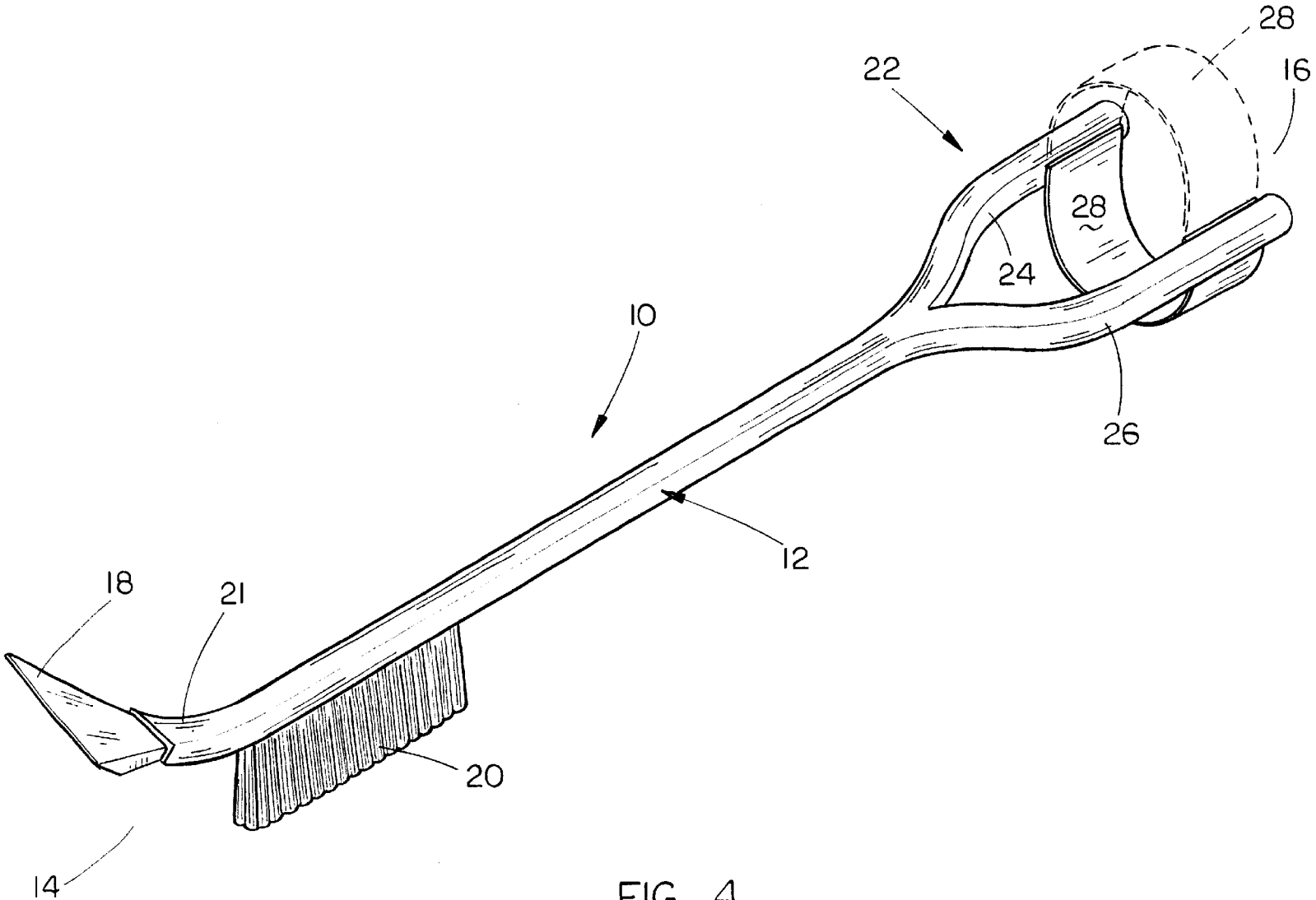
FIG. 4 is a perspective view of the invention similar to FIG. 1 except that the scraper has been rotated 180° for use as a snow brush.

A U-shaped yoke 22 is provided at end 16 of handle portion 12 and includes spaced-apart yoke members 24 and 26. Yoke members 24 and 26 may dwell in the same plane as handle portion 12 or may be offset therefrom. A U-shaped arm or wrist engaging member 28 is secured to and extends between yoke members 24 and 26, as seen in the drawings. Member 28 may be flexible or rigid, but is preferably flexible. If member 28 is flexible, it enables the ice scraper to be used in an "upside-down",fashion as will be described hereinafter and as shown in FIGS. 3 and 4.

Figure 2:
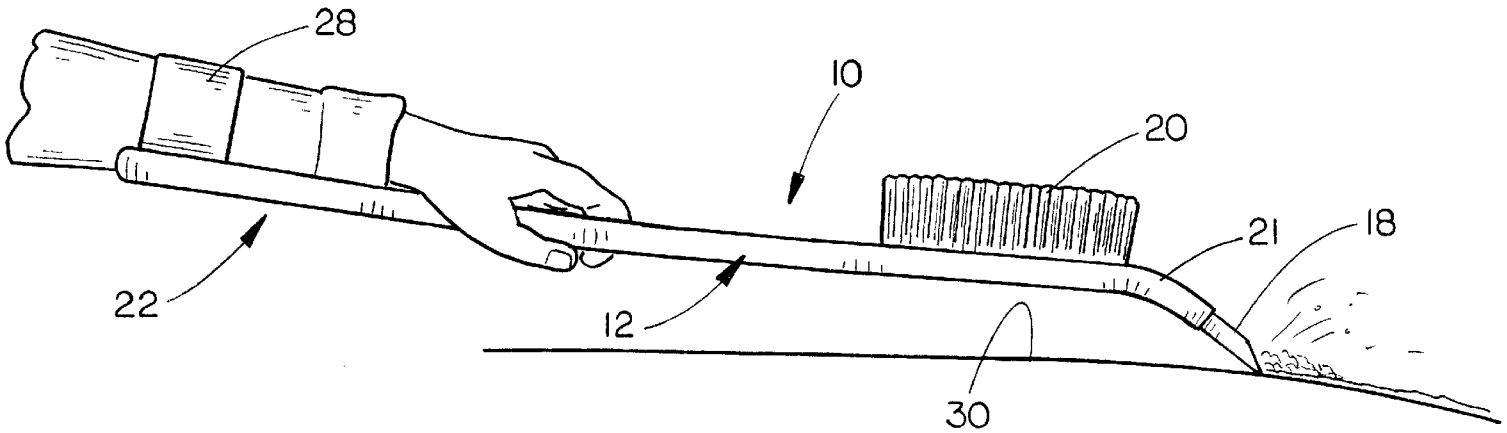
FIG. 2 is a view illustrating the ice scraper in use.

In use, if it is desired to scrape snow and/or ice from a vehicle window, the user inserts his or her hand and wrist beneath the U-shaped engaging member 28 and grasps the handle portion 12 adjacent the U-shaped yoke 22. (FIG. 2). The user then places the scraper blade 18 into contact with the window and moves the scraper blade relative to the window to scrape snow and ice therefrom. The user is able to apply sufficient pressure to the scraper blade 18 since the U-shaped engaging member 28 bears down against the person's wrist or lower arm thereby enabling the person to exert pressure or leverage onto the window surface. If it is desired to brush snow from the vehicle window, the ice scraper 10 of this invention is merely rotated 180° so that the brush 20 is oriented in a downwardly extending fashion. (FIG. 3). The flexible nature of the U-shaped engaging member 28 enables the member 28 to be reversed with respect to the yoke members 24 and 26 (FIG. 3) so that the user may exert pressure onto the brush in the same fashion as pressure was applied to the scraper blade 18. FIG. 4 illustrates the scraper 10 in its reversed position with the dashed lines illustrating the manner in which the member 28 may be reversed.

Thus it can be seen that the invention accomplishes at least all of its stated objectives.

I claim:

1. An ice scraper, comprising:

a single, substantially straight elongated handle portion having first and second ends;

an ice scraper blade provided at said first end of said handle portion;

an arcuate arm/wrist receiving member provided at said second end of said handle portion;

said arm/wrist receiving member comprising a flexible strap member;

and wherein a yoke is provided at said second end of said handle portion and wherein said arcuate arm/wrist receiving member is secured to said yoke.

2. The ice scraper of claim 1 wherein said yoke comprises spaced-apart first and second yoke members and wherein said arcuate arm/wrist receiving member is secured to and extends between said yoke members.

3. The ice scraper of claim 2 wherein said arcuate arm/wrist receiving member is generally U-shaped and has opposite ends, one end of said arm/wrist receiving member being secured to said first yoke member, the other end of said arm/wrist receiving member being secured to said second yoke member.

4. The ice scraper of claim 1 wherein an elongated snow brush is also provided at said first end of said handle portion; said snow brush having a longitudinal axis which is parallel to said handle portion.

* * * * *